United States Patent [19]

Edmondson

[11] Patent Number: 4,647,366

[45] Date of Patent: Mar. 3, 1987

[54] METHOD OF INHIBITING PROPIONIC ACID CORROSION IN DISTILLATION UNITS

[75] Inventor: James G. Edmondson, Conroe, Tex.

[73] Assignee: Betz Laboratories, Inc., Trevose, Pa.

[21] Appl. No.: 648,848

[22] Filed: Sep. 7, 1984

[51] Int. Cl.[4] ..... C10G 7/10

[52] U.S. Cl. ..... 208/47; 564/479; 208/347

[58] Field of Search ..... 208/47, 347; 564/479

[56] References Cited

U.S. PATENT DOCUMENTS

| | | | |
|---|---|---|---|
| Re. 18,958 | 9/1933 | Bottoms | 423/229 |
| 2,220,138 | 11/1940 | Wood | 208/227 |
| 2,238,201 | 4/1941 | Wilson et al. | 423/228 |
| 3,152,187 | 10/1964 | Coyne et al. | 564/479 |
| 3,211,667 | 10/1965 | Coyne et al. | 564/479 |
| 3,320,318 | 5/1967 | Riggs et al. | 564/479 |
| 3,458,453 | 7/1969 | Kautsky | 208/47 |
| 3,790,496 | 2/1974 | Hausler | 208/47 |
| 3,819,328 | 6/1974 | Go | 208/47 |

OTHER PUBLICATIONS

Gruse and Stevens, *The Chemical Technology of Petroleum,* p. 94, 2nd Ed. (1942), McGraw-Hill Book Co.

*Primary Examiner*—John Doll
*Assistant Examiner*—Lance Johnson
*Attorney, Agent, or Firm*—Alexander D. Ricci; Bruce E. Peacock

[57] ABSTRACT

The present invention is directed to the use of a reaction product of an alkynediol and a polyalkylene polyamine to control corrosion of metallic surfaces in contact with a substantially anhydrous elevated temperature mixture of a hydrocarbon and propionic acid. The method is particularly useful in controlling the corrosion of overheads in a crude unit of a refinery where problems of this nature are prevalent.

9 Claims, No Drawings

METHOD OF INHIBITING PROPIONIC ACID CORROSION IN DISTILLATION UNITS

BACKGROUND OF THE INVENTION

All crude oil contains impurities which contribute to corrosion, heat exchange fouling, furnace coking catalyst deactivation and product degradation.

Corrosion has always and is currently a significant problem in the refining industry because of the replacement costs and downtime associated therewith. As the industry has expanded and became more complex so have the corrosion problems.

Corrosion problems in a refinery operation and in particular a crude unit can be due to any one of or a combination of (i) those components found in crude oil (ii) the chemicals used in the refinery process, and (iii) environmental conditions. The present invention is directed to those corrosion problems which are due to one of the constituents normally contained in the crude oil or in some cases formed during the actual process. The four main impurities in crude oils which contribute to corrosion of condenser piping, distillation units and other structures of the refinery equipment include salts, sulfur compounds, naphthenic and other organic acids such as acetic and propionic acid, organic and inorganic acids.

The salts hydrolize during processing of the crude to produce hydrochloric acid which is very corrosive. Sulfur compounds are troublesome because they break down into hydrogen sulfide which in fact has the capacity to make the corrosion due to hydrochloric acid even more severe.

Naphthenic acid is a generic term used to identify a mixture of organic acids present in the petroleum stock, or which may be obtained due to the decomposition of the naphthenic and/or other organic acids. Acids of this nature include, but are not limited to, carbonic acetic and propionic acids and mixtures thereof which together with the naphthenic acid cause corrosion at temperature ranges of 150° to 750° F.

Accordingly, corrosion occurs due to those acids in centrifugal pumps, furnace tube inlets and return bends, transfer lines, crude tower flash zones, tower overheads, etc. These acids do not require an aqueous phase to cause corrosion and while in many cases they are not particularly corrosive at lower temperatures, they become much more aggressive at the elevated temperatures. Under these conditions rates as high as 0.35 inch per year have been reported for carbon steel and with aluminum it is also quite high, particularly when anhydrous (dry) conditions are prevelant. Acid neutralization number (mg. KOH/gm) is a quantitative indication of the naphthenic acids present in the crude, thus providing some evidence of the corrosive potential of the crude being processed. Crudes with naphthenic acid concentration of greater than 0.5 KOH/gm of crude appear to either possess or generate high acetic and/or propionic acids, thereby resulting in corrosion in the crude unit overheads.

In view of the foregoing then, the industry is constantly looking for techniques and inhibitors to combat corrosion caused by the various constituents contained in the oil being processed and by the chemicals formed during the processing and refining of petroleum and hydrocarbons.

GENERAL DESCRIPTION OF THE INVENTION

The present inventor directed his efforts in an attempt to resolve the corrosion of metal parts, e.g. ferrous metal, carbon steel, aluminum and the like. The type corrosion specifically addressed was that which takes place when metal comes in contact with a mixture of hydrocarbon and propionic acid at an elevated temperature (150°–750° F.) in a substantially anhydrous environment i.e., where there is a minimum amount of water present e.g., 0.5 to 500 parts per million parts of oil, hydrocarbon or the like being processed.

The present inventor discovered that if an effective amount for the purpose (0.5 to 500 parts per million of oil/hydrocarbon being processed) of an oil soluble reaction product of an alkynediol and a polyalkylene polyamine was added to the hydrocarbon being processed at 150° to 750° F. and more likely at temperatures of 300°–750° F. and containing propionic acid and that the mixture was substantially anhydrous, corrosion of the metal surface due to the propionic acid which would normally occur could be effectively controlled and/or inhibited.

The alkynediols which appear to be effective in producing the reaction product are those which contain from 2 to 8, and preferably from 3 to 6, carbon atoms. Examples of the alkynediols which should be suitable are propynediol, butynediol, pentynediol and the like. The polyalkylene polyamines which appear to be utilizable are those which contain from 2 to 10, and preferably 3 to 7, amine groups (substituted or unsubstituted) each separated by an alkylene group having from 1 to 6, and preferably 2 to 4 carbon atoms. Examples of the polyamines include ethylene diamine, diethylene triamine, pentaethylene hexamine, pentapropylene hexamine, treheptylene diamine and the like.

The weight ratio of the reactants are such as to attain full reaction between the respective ingredients with weight ratios of amine to diol of 4:1 to 1:1, with 3:1 being preferred.

SPECIFIC EMBODIMENT

Product A was prepared by utilizing 51.4 lbs of 35% active butynediol, and 48.6 lbs of pentaethylene hexamine, with copper acetate (0.5% aqueous) added as a catalyst. The ingredients were premixed and agitated until a complete mixture was ensured. The premix was then placed in a reactor with distillation unit and the temperature brought up to, controlled and maintained at 350°–400° F. for a time sufficient to ensure total reaction. The resulting material was then diluted to 75% active with water to provide Product A. Product A was then utilized to test the efficacy of such in a propionic acid corrosion test.

EXPERIMENTAL

A. The data which are set forth below were generated by corrosion "wheel tests." Deodorized kerosene was used as the hydrocarbon and is representative of crude unit middle distillates and initial overhead hydrocarbon condensates. Kerosene and propionic acid were mixed at the stated percentages on a volume basis. Some water was present in the test fluids due to the water content of the laboratory grade propionic acid (0.1 to 0.25%). In all cases the calculated water content was below 500 ppm; this concentration of water was soluble and no free water phase was observed, either before or after the test periods. Pre-cleaned and pre-weighed, mild steel coupons were exposed to the corrosive fluids for ~18 to ~21 hours at 150° or 160° F. with continuous agitation. Inhibitor concentrations are based on the total fluid volumes of 100 mLs. and are on an active ingredient basis. Each data point is an average of two to four runs.

The corrosivity of nominally dry kerosene/propionic acid solutions is shown in Table I. The test contained 0 to 500 ppm water in direct proportion to the amount of propionic acid used. Average metal penetration rates (mpy) are indicative of severe corrosion at concentrations of propionic acid between 5 and 50%. Corrosion rate leveled off at between 20 and 50% propionic acid.

TABLE I

| TEST DURATION: 17.3 hours @ 150° F. | | |
|---|---|---|
| % Propionic Acid | ppm $H_2O$ | mpy |
| 0 | 0 | 0.8 |
| 5 | 50 | 71 |
| 10 | 100 | 186 |
| 20 | 250 | 257 |
| 50 | 500 | 268 |

B. Ten percent propionic acid was chosen for subsequent evaluation of generally recognized filming amines with various molecular structures and functional groups. Previous data generated in this laboratory and others show that these amines are very effective against mineral acid corrosion (1–7% aqueous HCl) in mixed hydrocarbon/aqueous fluids (95% kerosene/5% acid solution). As shown in Table II, the generally recognized corrosion inhibitors were ineffective against organic acid attack on mild steel in hydrocarbon media. However, the composition of this invention is highly effective for non-aqueous acid corrosion, even though it is not an effective mineral acid inhibitor.

TABLE II

TEST DURATION: 18 to 20.8 hours @ 150° or 160° F.
Results in Percent Protection*

| Conc., ppm | Product A | Commercial Product 1 | Commercial Product 2 | Commercial Product 3 | Commercial Product 4 |
|---|---|---|---|---|---|
| 5 | 40.6% | 4.8% | — | — | −15.6% |
| 10 | 73.6% | 2.0% | 1.2% | −5.7% | −2.5% |
| 20 | 92.6% | −2.1% | −3.7% | −24.6% | −2.1% |

$$^{*}\% \text{ Protection} = \frac{(\text{wgt. loss of blank} - \text{wgt. loss of treated})}{(\text{wgt. loss of blank})} 100$$

avg. blank: 147.2 mg., standard deviation: 12.4 mg.

Additional studies were performed in order to confirm and expand the data represented in Table II. Product B as set forth in Table III were prepared in accordance with the procedure set forth above utilizing the described ingredients at equal weight ratios.

TABLE III

| 10% Propionic Acid/90% Kerosene (Approx. 20 hrs. @ 150° F.) Product B | |
|---|---|
| Conc. ppm | % Protection |
| 10 | 51.7 |
| 50 | 97.0 |

TABLE IV

| Propionic Acid/Kerosene (~20 hrs. @ 150° F.) Results in % Protection | | |
|---|---|---|
| Conc., ppm | 10% Propionic Acid Product A | 20% Propionic Acid Product A |
| 10 | 73.6* | 8.6 |
| 20 | 92.6* | 17.6 |
| 25 | 95.6 | — |
| 50 | 99.2 | — |
| 100 | 99.0 | — |

Blank wgt. loss: 164.2 mg (250 ppm $H_2O$) 213.4 mg (500 ppm $H_2O$)
*from Table II.

It is apparent that against 10% propionic acid, the product of the invention is quite effective. However, the data for the 20% propionic acid test was not particularly conclusive since it was not developed to the extent of the other test. It is believed that higher dosages would be required because of the severity of the test.

As indicated earlier, the compositions of the present invention are not particularly effective against inorganic acids, primarily hydrochloric acid. Testing of the composition also indicated that they were not particularly effective against acetic acid in spite of the fact that propionic and acetic acids only differ by one carbon.

Accordingly, when the product was fed to the crude unit of a California refinery, no corrosion protection was seen. This lack of effect was later determined to be the result of an excess of hydrochloric acid and acetic acid in the system. Because of the highly corrosive effect of these acids, no protection could be discerned or attributed to the product of this invention. However, in spite of this, the inventor believes that the present invention has applicability to any hydrocarbon systems where propionic acid presents a corrosion problem. Moreover, it is believed that the compositions of the present invention may be formulated with others that are effective against either or both of hydrochloric and acetic acid to provide the protection desired.

I claim:

1. A method for inhibiting and/or controlling the liquid phase corrosion of metal surfaces in a crude oil distillation unit, which surfaces are in contact with a liquid mixture of a hydrocarbon and propionic acid at an elevated temperature, and which surfaces would otherwise be corroded primarily by the action of said propionic acid, which mixture contains a minimal amount of water, which method comprises adding to said mixture a sufficient amount for the purpose of the reaction product of an alkynediol and a polyalkylene polyamine, which reaction product is soluble in said mixture and contains no appreciable amount of water.

2. A method according to claim 1 wherein the reaction product is added in an amount of 0.5 to 500 parts per million parts of propionic acid in said mixture.

3. A method according to claim 2 wherein said metal surface is a ferrous metal surface.

4. A method according to claim 3 wherein the mixture is at a temperature of 150° to 750° F.

5. A method according to claim 4 wherein the alkyne group contains from about 2 to 8 carbon atoms.

6. A method according to claim 5 wherein said polyalkylene polyamine contains from 2 to 10 amine groups, each separated from another by an alkylene group having from 1 to 6 carbon atoms.

7. A method according to claim 6 wherein the alkyne contains from 3 to 6 carbon atoms.

8. A method according to claim 7 wherein the alkynediol is butynediol.

9. A method according to claims 7 or 8 wherein the polyamine is pentaethylene diamine.

* * * * *